US006991520B2

(12) United States Patent
Doy

(10) Patent No.: US 6,991,520 B2
(45) Date of Patent: Jan. 31, 2006

(54) ABRASIVE MACHINE AND METHOD OF ABRADING WORK PIECE

(75) Inventor: Toshiroh Doy, 3-2970-53, Mihara-cho, Tokorozawa-shi, Saitama (JP) 359-0045

(73) Assignees: Toshiroh Doy, Saritama (JP); Fujikoshi Machinery Corp., Nagano (JP)

( * ) Notice: Subject to any disclaimer, the term of this patent is extended or adjusted under 35 U.S.C. 154(b) by 0 days.

(21) Appl. No.: 10/303,156

(22) Filed: Nov. 22, 2002

(65) Prior Publication Data

US 2003/0104766 A1 Jun. 5, 2003

(30) Foreign Application Priority Data

Nov. 30, 2001 (JP) ..... 2001-367096
Aug. 30, 2002 (JP) ..... 2002-255192

(51) Int. Cl.
*B24B 1/00* (2006.01)

(52) U.S. Cl. ..... 451/41; 451/60; 451/285; 451/287; 451/288; 451/289; 451/446

(58) Field of Classification Search ..... 451/41, 451/60, 285, 287, 288, 289, 446
See application file for complete search history.

(56) References Cited

U.S. PATENT DOCUMENTS 5,348,615 A 9/1994 Gupta
5,618,177 A * 4/1997 Abbott ..... 433/88
5,817,245 A * 10/1998 Iwamoto et al. ..... 216/88
6,095,898 A * 8/2000 Hennhofer et al. ..... 451/7
6,261,406 B1 * 7/2001 Jurgensen et al. ..... 156/345

FOREIGN PATENT DOCUMENTS

WO 00/18544 4/2000
WO 02/38335 5/2002

* cited by examiner

*Primary Examiner*—Joseph J. Hail, III
*Assistant Examiner*—Shantese McDonald
(74) *Attorney, Agent, or Firm*—Jordan and Hamburg LLP

(57) ABSTRACT

The abrasive machine of the present invention is capable of changing pressure applied to a work piece and easily defining optimum abrading conditions. The abrasive machine comprises: a pressure vessel capable of increasing and reducing inner pressure; an abrasive plate provided in the pressure vessel; a pressing plate provided on the abrasive plate, the pressing plate pressing the work piece onto the abrasive plate; a driving unit relatively moving the abrasive plate with respect to the pressing plate so as to abrade the work piece; and a pressure source connected to the pressure vessel, the pressure source increasing or reducing the inner pressure of the pressure vessel.

24 Claims, 8 Drawing Sheets

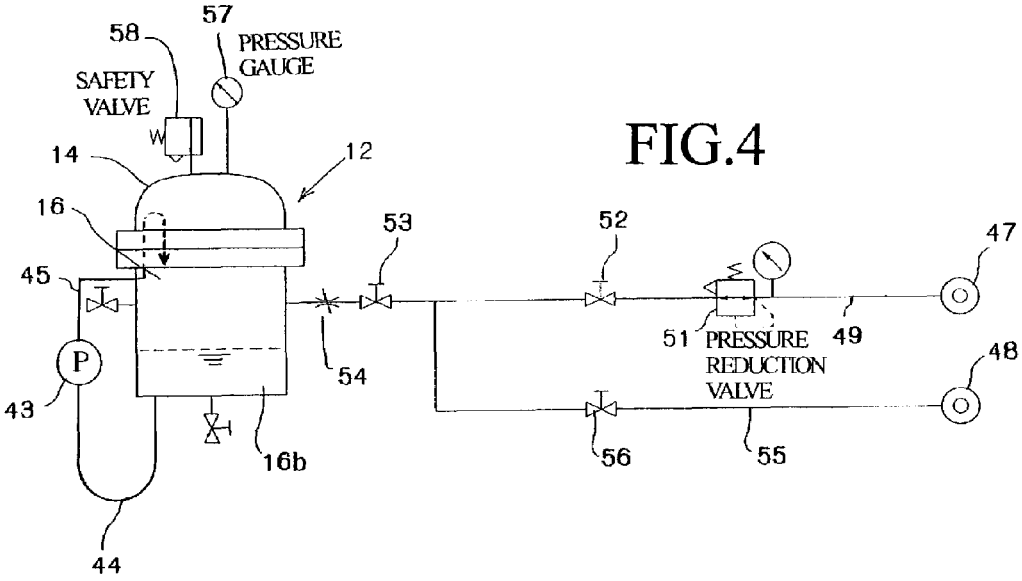
FIG.4
FIG.5
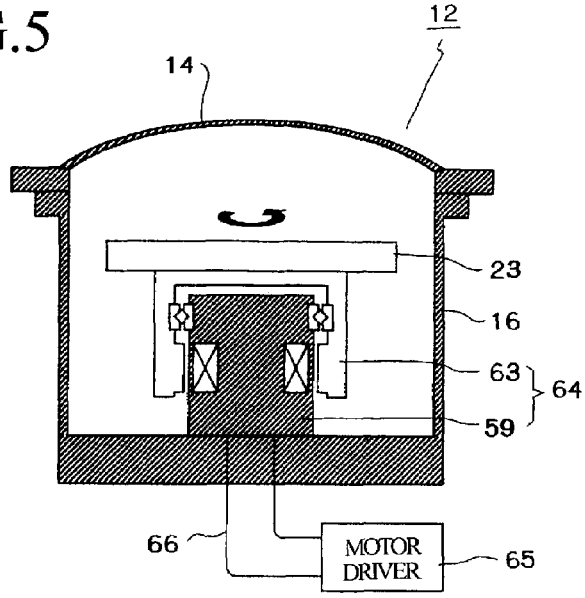

ABRASIVE MACHINE AND METHOD OF ABRADING WORK PIECE

BACKGROUND OF THE INVENTION

The present invention relates to an abrasive machine and a method of abrading a work piece, e.g., silicon wafer.

A technique of Chemical-Mechanical Polishing (CMP) is considered as an important technique for high density multi-layered wiring.

There are many related factors in the CMP, such as kinds of slurry, rotational speed of an abrasive plate, kinds of abrasive pads, temperature, etc. Therefore it is difficult to select optimum abrading conditions under which desired abrasion rate and flatness can be gained.

SUMMARY OF THE INVENTION

The present invention has been invented so as to overcome the disadvantage of the CMP.

An object of the present invention is to provide an abrasive machine and a method of abrading a work piece capable of changing pressure applied to the work piece, which seldom relates to the CMP factors, and easily defining the optimum abrading conditions.

To achieve the object, the present invention has following structures.

Namely, the abrasive machine of the present invention comprises:

a pressure vessel having a lid which opens or closes the pressure vessel, the pressure vessel being capable of increasing and reducing inner pressure;

an abrasive plate being provided in the pressure vessel;

a pressing plate being provided on the abrasive plate, the pressing plate pressing a work piece, which has been set between the abrasive plate and the pressing plate, onto the abrasive plate;

a driving unit relatively moving the abrasive plate with respect to the pressing plate so as to abrade the work piece; and a pressure source being connected to the pressure vessel, the pressure source increasing or reducing the inner pressure of the pressure vessel.

On the other hand, the method of the present invention is a method of abrading a work piece in an abrasive machine comprising: a pressure vessel having a lid which opens or closes the pressure vessel, the pressure vessel being capable of increasing and reducing inner pressure; an abrasive plate being provided in the pressure vessel; a pressing plate being provided on the abrasive plate, the pressing plate pressing a work piece, which has been set between the abrasive plate and the pressing plate, onto the abrasive plate; a driving unit relatively moving the abrasive plate with respect to the pressing plate so as to abrade the work piece; and a pressure source being connected to the pressure vessel, the pressure source increasing or reducing the inner pressure of the pressure vessel, the method comprises the steps of:

setting the work piece between the abrasive plate and the pressing plate;

introducing a gas into the pressure vessel; and relatively moving the abrasive plate with respect to the pressing plate by the driving unit so as to abrade the work piece.

In the present invention, the abrasive plate and the pressing plate are provided in the pressure vessel, and the work piece can be abraded in a state-of increasing or reducing the inner pressure of the pressure vessel, so that the abrading conditions can be easily controlled by adjusting the inner pressure of the pressure vessel.

BRIEF DESCRIPTION OF THE DRAWINGS

Embodiments of the present invention will now be described by way of examples and with reference to the accompanying drawings, in which:

FIG. 4 is an explanation view a pressure source connected to the bell jar;

FIG. 5 is an explanation view of a driving unit of another example;

DETAILED DESCRIPTION OF THE EMBODIMENTS

Preferred embodiments of the present invention will now be described in detail with reference to the accompanying drawings.

Figure 1:
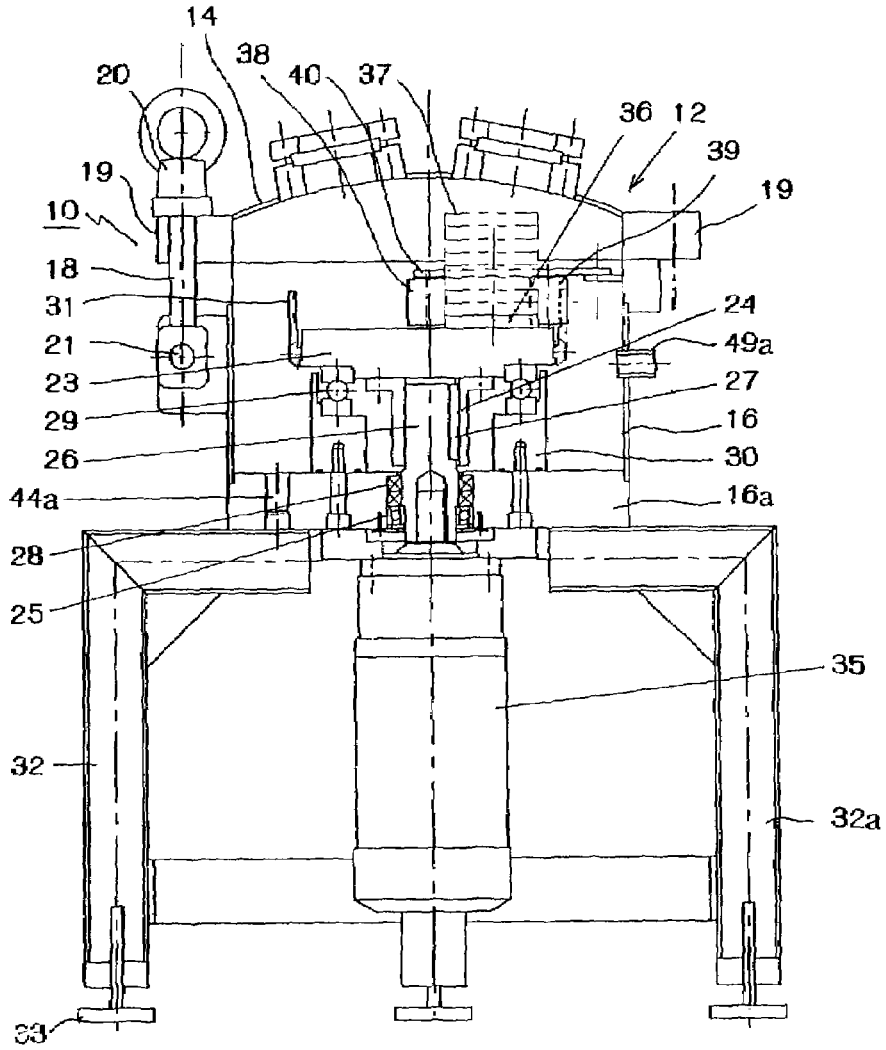
FIG. 1 is a front sectional view of an abrasive machine of an embodiment of the present invention.
Figure 2:
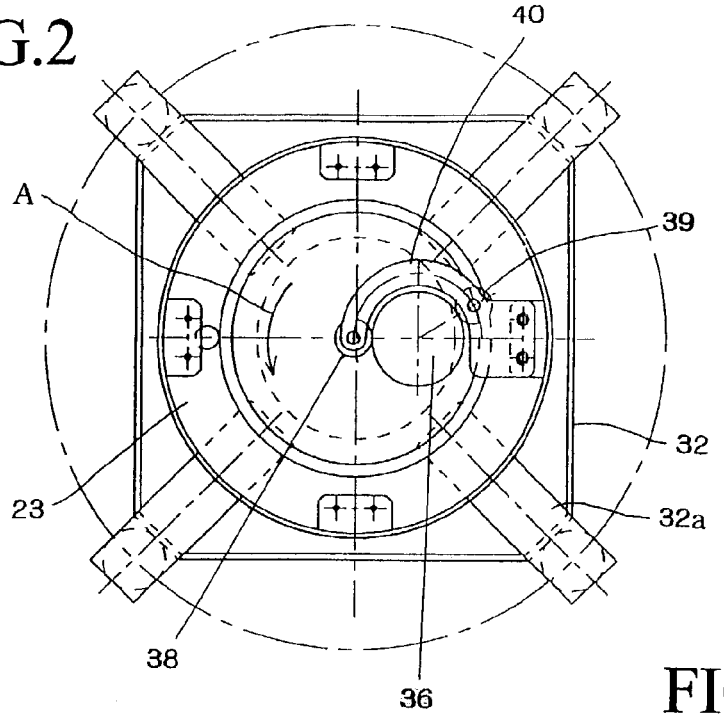
FIG. 2 is a plan view of the abrasive machine, in which a lid is opened.
Figure 3:
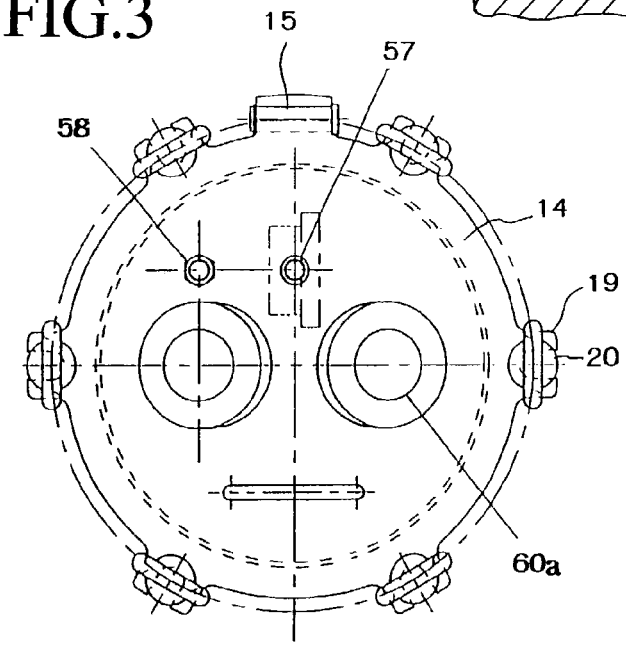
FIG. 3 is a plan view of a bell jar.

FIG. 1 is a front sectional view of an abrasive machine of an embodiment of the present invention;

FIG. 2 is a plan view of the abrasive machine, in which a lid is opened; and FIG. 3 is a plan view of a bell jar.

The bell jar 12 has a lid 14 and acts as a pressure vessel capable of bearing increase and reduce of pressure therein. The lid 14 is pivotably attached to a body proper 16 of the bell jar 14 by a shaft 15 so as to open and close the body proper 16.

A lower end of a clamping bolt 18 is pivotably attached to the body proper 16 by a shaft 21; an upper end of the bolt 18 is capable of entering a gap between U-shaped forks of a fixed arm 19. By turning a nut 20, the lid 14 can air-tightly close the body proper 16. In the present embodiment, six clamping bolts 18 are provided with angular separations of 60 degrees.

The body proper 16 is made of steel having a prescribed thickness and formed into a bottomed cylindrical shape. A top plate of the lid 14 is curved upward. With this pressure-resisting structure, the bell jar 12 can act as the pressure vessel. A bottom section 16*a* of the body proper 16 is a flat plate, and its thickness is much thicker than that of a cylindrical section so as to bear inner pressure.

Note that, the shape of the bell jar 12 is not limited to the cylindrical shape. Other pressure vessels which have enough pressure-resisting structure can be employed in the present invention.

An abrasive plate 23 is provided in the bell jar 12.

An abrasive cloth or an abrasive pad (not shown), which is made of a known material, is adhered on an upper face of the abrasive plate 23.

A connecting member 24, which is formed into a cylindrical shape, is fixed on a bottom face of the abrasive plate 23. The connecting member 24 is connected to a rotary shaft 26, which is rotatably held by a bearing 25 of the bottom section 16*a,* by a key 27. With this structure, the abrasive plate 23 is rotated together with the rotary shaft 26. A symbol 28 stands for a sealing member.

A lower end part of the abrasive plate 23 is supported by a thrust bearing 29. A supporting member 30 is provided on the bottom section 16*a,* and the thrust bearing 29 is provided on the supporting member 30.

A cover 31 encloses an outer circumferential face of the abrasive plate 23 so as to remain prescribed amount of slurry on the abrasive plate 23. Note that, the cover 31 may be omitted.

A supporting base 32 supports the bell jar 12 and has four legs 32*a*. An adjustable bolt 33 is provided to a lower end of each leg 32*a* so as to adjust height of the supporting base 32 and levelness of the bell jar 12.

A motor 35, which acts as a driving unit, is attached to the supporting base 32. A motor shaft of the motor 35 is connected to the rotary shaft 26, so that the motor 35 can rotate the abrasive plate 23. In the present embodiment, the motor 35 is provided outside of the bell jar 12, but the motor 35 may be provided in the bell jar 12.

A pressing plate 36 for pressing a work piece (not shown) is provided on the abrasive plate 23. The pressing plate 36 applies own weight to the abrasive plate 23 as a pressing force. The work piece to be abraded is set or sandwiched between the abrasive plate 23 and the pressing plate 36.

A plurality of weights 37 are mounted on the pressing plate 36 so as to adjust the pressing force. The weights 37 act as a press unit for applying pressure to the work piece.

Note that, number of the weights 37 is optionally determined on the basis of abrading conditions.

A roller 38, which is coaxial with the abrasive plate 23, and a roller, which is provided above an outer edge of the abrasive plate 23, contact an outer edge of the pressing plate 36, so that the pressing plate 36 can be held at a prescribed position on the abrasive plate 23. The rollers 38 and 39 are rotatably held by an arc-shaped arm 40 provided in the bell jar 12.

In FIG. 2, the abrasive plate 23 is rotated in a direction "A". By rotating the abrasive plate 23, the pressing plate 36 too is rotated, about its own axis, in the same direction.

Note that, the roller 38 may be rotated by a motor (not shown) so as to rotate the pressing plate 36, which contacts the roller 38, in a prescribed direction.

A proper amount of slurry is stored in the body proper 16. In the present embodiment, a lower part of the body proper 16 acts as a slurry storing section 16*b* (see FIG. 4).

As shown in FIG. 4, the slurry stored in the body proper 16 is circulated by a circulation pump 43.

The circulation pump 43 is connected to a pipe 44, which is connected to the slurry storing section 16*b,* and a pipe 45, which is connected to an upper part of the body proper 16. The slurry stored in the slurry storing section 16*b* is drawn by the pump 43 and supplied onto the abrasive plate 23 via the pipe 45. The slurry, which has been used to abrade the work piece, is collected in the slurry storing section 16*b*.

The slurry storing section 16*b,* the circulation pump 43 and the pipes 44 and 45, etc. constitute a slurry supplying unit. Note that, a symbol 44*a* shown in FIG. 1 stands for a connecting section of the pipe 44.

The slurry storing section 16*b,* of course, may be provided outside of the bell jar 12.

In FIG. 4, a pressurizing unit 47 and a pressure reduction unit 48 constitute a pressure source.

The pressurizing unit 47 is connected to the body proper 16 via a pipe 49 so as to introduce a pressurized fluid into the bell jar 12. In the present embodiment, air, oxygen, nitrogen and argon gas are employed as the fluid. Other gasses may be optionally employed. The fluids are selected and supplied into the bell jar 12 by a switching valve (not shown). A pressure reduction valve 51 is provided so as to supply the fluid into the bell jar 12 with predetermined pressure. Symbols 52 and 53 are valves, and a symbol 54 is a flow control valve capable of controlling amount of flow of the fluid.

Note that, a mixed gas may be employed as the fluid.

The pressure reduction unit 48 is connected to a part of the pipe 49, which is located between the valves 52 and 53. A symbol 56 stands for a valve.

The pressure reduction unit 48 includes a vacuum pump.

Note that, a symbol 49*a* shown in FIG. 1 stands for a connecting section of the pipe 49.

By closing the valve 56 and opening the valves 52 and 53, the pressurized fluid can be introduced into the bell jar 12, so that inner pressure of the bell jar 12 can be increased. On the other hand, by closing the valve 52 and opening the valves 53 and 56, the pressure reduction unit 48 sucks the fluid in the bell jar 12, so that the inner pressure of the bell jar 12 can be reduced.

A pressure gauge 57, which acts as a measuring equipment, measures the inner pressure of the bell jar 12. Other equipments for measuring temperature, humidity, etc. may be provided if required.

A safety valve 58 releases the pressurized fluid outside when the inner pressure of the bell jar 12 exceeds a prescribed value. A symbol 60*a* stands for a viewing window (see FIG. 3).

Another example of the driving unit is shown in FIG. 5.

A motor 64 including a stator 59 and a rotor 63 is provided in the bell jar 12, and the abrasive plate 23 is fixed on the rotor 63. A motor driver 65 is provided outside of the bell jar 12, and electric power is supplied to stator coils via wires 66. Note that, the motor 64 is a known electric motor.

In this driving unit, only the wires 66 should be sealed, therefore the sealing mechanism can be simplified.

Figure 6:
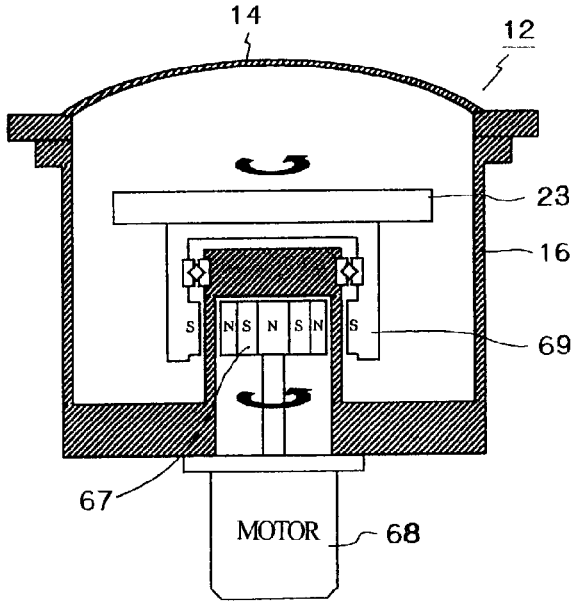
FIG. 6 is an explanation view of the driving unit of other example.

Further, another example of the driving unit is shown in FIG. 6.

In this example, the abrasive plate 23 is rotated by magnetic coupler means. Namely, a first magnet rotor 67, in which North magnetic poles and South magnetic poles are alternately formed on an outer circumferential face, is rotated by a motor 68. By rotating the first magnet rotor 67, a second magnet rotor 69 is rotated. The abrasive plate 23 is fixed on the second magnet rotor 69.

With this structure, the abrasive plate 23 can be rotated without contacting any members located outside, therefore an inner space of the bell jar 12 can be clean.

In the present embodiment, the abrasive plate 23 is rotated about its own axis. In another embodiment, the abrasive plate 23 may be moved in a plane parallel to an abrasive face (the upper face) of the abrasive plate 23. This embodiment is shown in FIG. 7.

Figure 7:
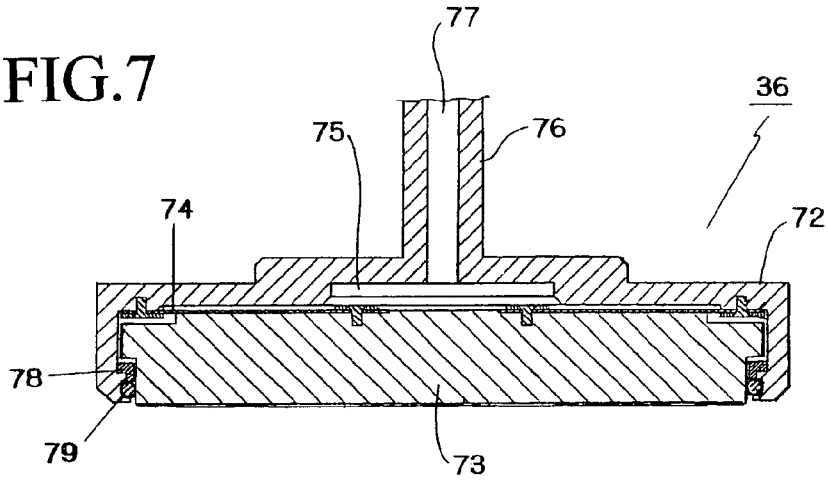
FIG. 7 is an explanation view of a mechanism for moving an abrasive plate.

In FIG. 7, a plurality of crank shafts 70 are attached to the abrasive plate 23, and the crank shafts 70 are synchronously rotated by a driving unit (not shown), which is provided outside of the bell jar 12. With this structure, the abrasive plate 23 can be moved along a circular orbit with fixed heading. Namely, all points in the abrasive plate 23 equally rotate in a direction "B".

In the above described embodiment, the work piece is merely pressed onto the abrasive plate 23 by the pressing plate 36. The work piece may be adhered on a bottom face of the pressing plate 36. In this case, the abraded work piece is peeled from the pressing plate 36 when the abrasion is completed.

The pressing member 36 may have sucking means for holding the work piece by producing negative pressure. In this case, the sucking means may suck and hold the work piece directly or with an elastic bucking member.

In the above described embodiment, the weights 37 are employed as the press unit. A cylinder unit (not shown) provided on the arm 40 may be employed to apply pressure to the work piece.

Figure 8:
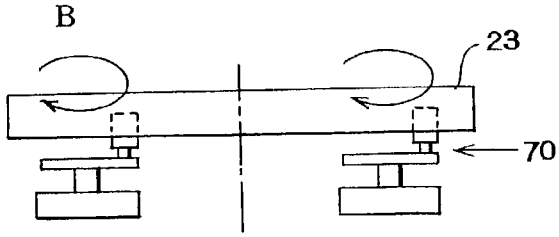
FIG. 8 is a sectional view of a press-type pressing plate.

Further, a pressure head-type pressing plate may be employed. An example of the pressure head-type pressing plate 36 is shown in FIG. 8.

A holding member 73 is suspended in a head proper 72 by an elastic ring member 74, e.g., diaphragm. With this structure, a pressure chamber 75 is formed. The pressurized fluid is introduced into the pressure chamber 75, so that the work piece held on a bottom face of the holding member 73 is pressed onto the abrasive plate 23. Preferably, the pressing plate 36 is rotated about a rotary shaft 76 by a motor (not shown). A driving mechanism including the motor may be provided on the arm 40.

Further, the pressing plate 36 may be vertically moved by a cylinder unit (not shown) so as to move to and away from the abrasive face (the abrasive cloth) of the abrasive plate 23. In this case, the rotary shaft 76 may be rotatably held by a holding arm (not shown), and the holding arm may be vertically moved by a cylinder unit (not shown) provided on the arm 40.

The driving mechanism allows the rotary shaft 76 to vertically move in a prescribed range and transmits torque of the motor.

The pressurized fluid is introduced into the pressure chamber 75 via a fluid path 77 formed in the rotary shaft 76. The fluid is introduced into the fluid path 77 via a rotary joint (not shown).

A restraining ring 78 prevents the holding member 73 from coming out from the head proper 72 and guides the vertical movement of the holding member 73.

An O-ring 79 is provided between an inner circumferential face of the head proper 72 and an outer circumferential face of the holding member 73. The O-ring 79 absorbs horizontal movement of the holding member 73 and prohibits the slurry to enter the head proper 72.

Experiments were executed in the abrasive machine 10 under the following conditions. Note that, the inner air pressure of the bell jar 12 was varied; and the copper layer, the $SiO_2$ layer and the Si substrate of the work piece were abraded.

The conditions were,

Abrasive cloth: IC1000/SUBA400 (trade name), diameter 200 mm;

Slurry: silica slurry "SS-25" for $SiO_2$
colloidal silica "Compol-80" for Si
alumina slurry for Copper;

Pressing force of the pressing plate 36: 100–500 g/cm$^2$;

Rotational speed of the abrasive plate 23: 15–90 rpm; and

Abrasion time: 2–4 min.

The work piece were abraded with the fixed pressing force, the fixed rotational speed and the fixed abrasion time under above conditions. The results are shown in FIG. 9.

Figure 9:
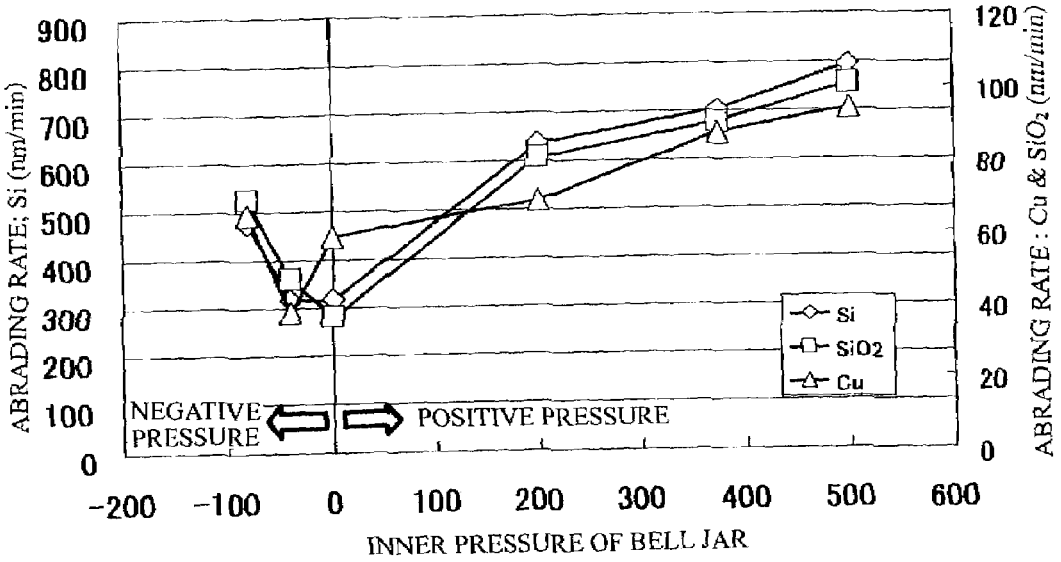
FIG. 9 is a graph showing a relationship between air pressure and abrasion rate.

In FIG. 9, the inner pressure of zero is the atmospheric pressure. Namely, the horizontal axis or the inner pressure of the bell jar 12 indicates the pressure added to and reduced from the atmospheric pressure.

As clearly shown in FIG. 9, abrasion rate under the atmospheric pressure was minimum; the abrasion rate was increased in nearly proportion to increasing and reducing the inner pressure.

Especially, in the case of abrading the $SiO_2$ layer and the Si substrate, the abrasion rate of 200 KPa was about twice as great as that of the atmospheric pressure; and the abrasion rate of 500 KPa was about 2.5 times as great as that of the atmospheric pressure.

In the case of abrading the copper layer, the minimum abrasion rate appeared on the negative pressure side (about −50 KPa). Namely, the minimum abrasion rate was slightly shifted toward the negative pressure side, but the abrasion rate was increased on the both sides of the minimum as well as the $SiO_2$ layer and the Si substrate.

The inventor thinks that the reasons of increasing the abrasion rate under the positive pressure are: the fluid pressure is applied to the pressing plate 36; and the slurry is permeated into the abrasive cloth by the fluid pressure.

The reason of increasing the abrasion rate under the negative pressure is not clearly found. The inventor thinks that frictional heat between the work piece and the abrasive cloth is hardly radiated due to pressure reduction so that temperature rises and reaction rate is increased. By increasing the reaction rate, the abrasion rate is increased under the negative pressure.

Figure 10:
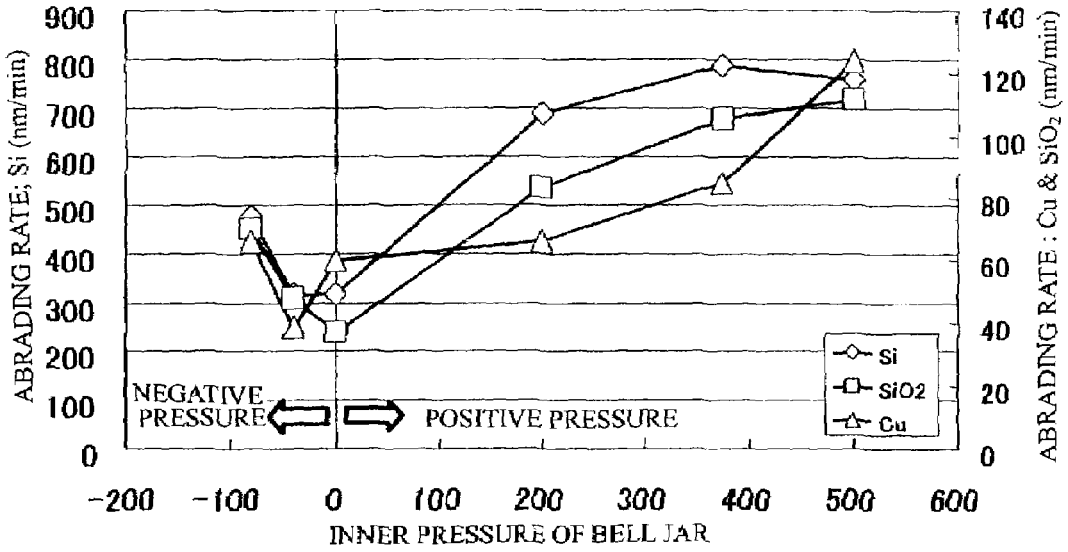
FIG. 10 is a graph showing a relationship between oxygen gas pressure and abrasion rate.

FIG. 10 is a graph showing a relationship between oxygen gas pressure and the abrasion rate. Oxygen was used as the fluid instead of the air.

Tendency of the case of employing oxygen is nearly equal to that of the case employing the air. Especially, in the case of abrading the copper layer, the abrasion rate was much increased under high pressure.

According to the results, the abrasion rate can be controlled by adjusting the inner pressure of the bell jar 12 without changing other conditions.

For example, when the abrasion is started and the work piece is roughly abraded, the inner pressure of the bell jar 12 is increased or reduced so as to abrade the work piece with high abrasion rate; when the work piece is finished and the work piece, the inner pressure of the bell jar 12 is returned to zero or the atmospheric pressure so as to abrade the work piece with low abrasion rate.

Of course, the abrasion rate may be controlled by combining other factors, e.g., the rotational speed of the abrasive plate 23.

In the case of using a plurality of kinds of slurry or abrasive cloth, a plurality of abrading stations are provided in one abrasive machine, so that the abrasive machine must be large. However, the inner pressure of the bell jar 12 and the rotational speed of the abrasive plate 23 can be changed at one abrading station, so number of the abrading stations can be reduced, the abrading conditions can be easily determined, a size of the abrasive machine can be smaller and manufacturing cost of the machine can be reduced.

The slurry accommodated in the bell jar 12 is pressurized and circulated, so load of the circulation pump 43 is not so great.

If the slurry storing section is provided outside of the bell jar 12, the slurry is introduced into the bell jar 12 whose inner pressure has been increased, so that a high power circulation pump is required.

The slurry may stay in the bell jar 12. In this case, the abrasive plate 23 is inclined with respect to the horizontal plane, by adjusting the adjustable bolts 33, so as to dip a lower part of the surface of the abrasive plate 23 in the slurry. With this structure, the slurry can be always permeated into the abrasive cloth for abrading the work piece.

Figure 11:
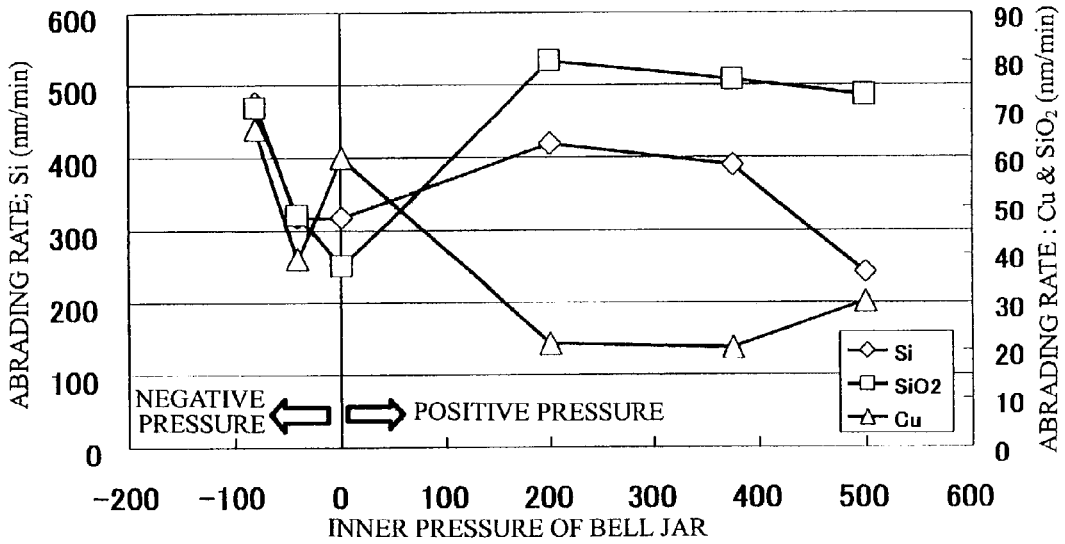
FIG. 11 is a graph showing a relationship between nitrogen gas pressure and abrasion rate.

FIG. 11 is a graph showing a relationship between nitrogen gas pressure and the abrasion rate. An inert gas, e.g., nitrogen, was used as the fluid instead of the air. The air in the bell jar 12 was purged by nitrogen, then the inner pressure was increased and reduced.

Under the negative pressure, the abrasion rate was increased as well as the case of employing air and oxygen (see FIGS. 9 and 10).

On the other hand, under the positive pressure, especially in the case of abrading the copper layer, the abrasion rate was reduced until 400 KPa.

The inventor thinks that the copper layer is easily oxidize, therefore a mechanism of the abrasion under the non-oxygen atmosphere (see FIG. 11) is different from that under the oxygen atmosphere (see FIGS. 9 and 10). Namely, under the oxygen atmosphere, the copper layer is etched by the slurry and the oxidation, so that the abrasion rate is high; under the non-oxygen atmosphere, the copper layer is etched by the slurry only, so that the abrasion rate is low.

Figure 12:
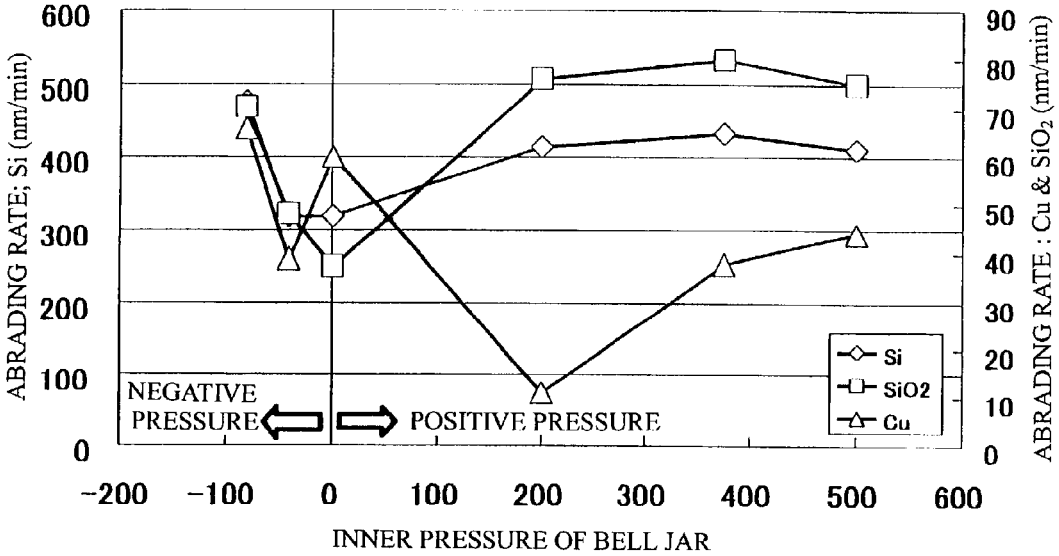
FIG. 12 is a graph showing a relationship between argon gas pressure and abrasion rate.

FIG. 12 is a graph showing a relationship between argon gas pressure and the abrasion rate. Argon was used as the fluid.

As clearly shown in the drawing, tendency of the case of employing the argon gas is nearly equal to that of the case employing the nitrogen gas.

Figure 13:
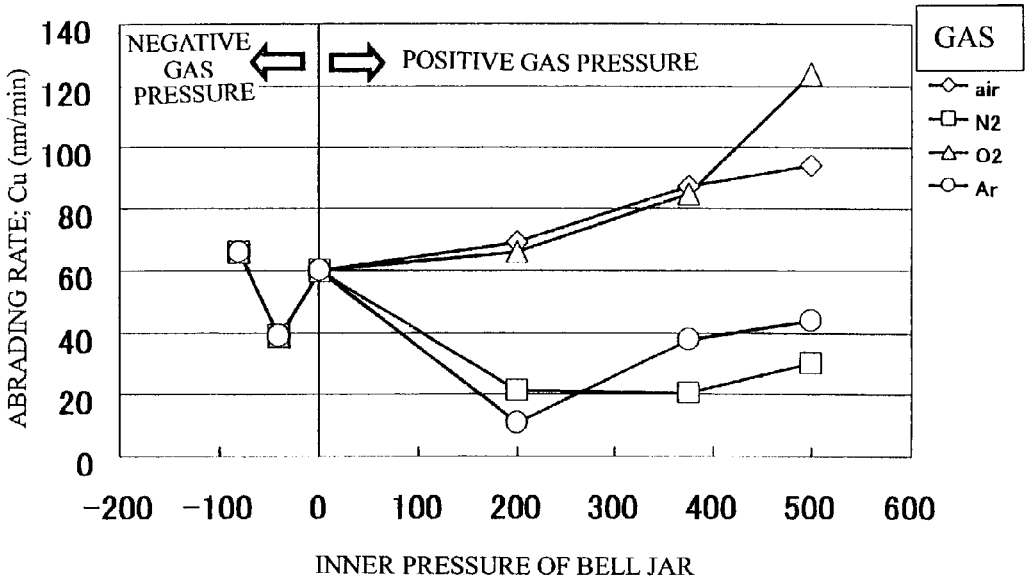
FIG. 13 is a graph of rate of abrading a copper layer in various gas atmospheres.

FIG. 13 is a graph of the rate of abrading the copper layer in various gas atmospheres.

Figure 14:
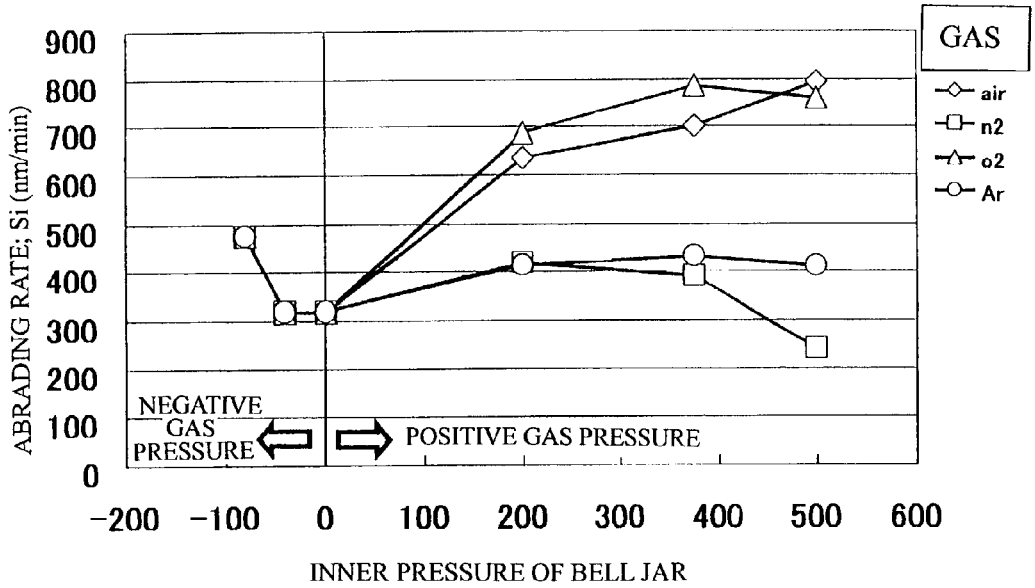
FIG. 14 is a graph of rate of abrading an Si substrate in the various gas atmospheres.

FIG. 14 is a graph of the rate of abrading the Si substrate in the various gas atmospheres.

Figure 15:
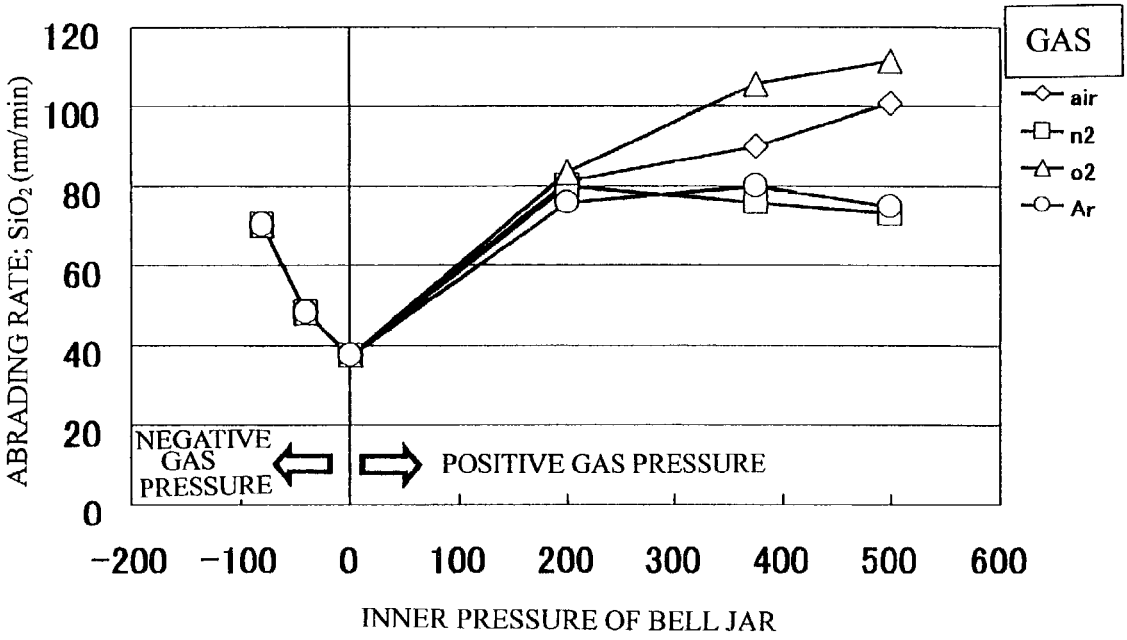
FIG. 15 is a graph of rate of abrading an $SiO_2$ layer in the various gas atmospheres.

FIG. 15 is a graph of the rate of abrading the $SiO_2$ layer in the various gas atmospheres.

By properly selecting the pressurized fluid, the abrasion rate can be controlled by adjusting the fluid pressure only. In the case of selectively employing the fluids (gasses), a plurality of gas supplying units which respectively supply different gasses are provided in one abrasive machine 10, and the gas supplying units are selected by a switching valve.

Figure 16:
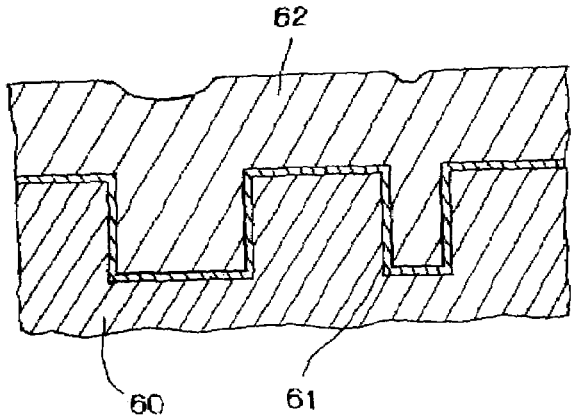
FIG. 16 is a sectional view of copper wires implanted in a barrier metal layer.

A method of abrading implanted copper wires, which are insulated by the $SiO_2$ layer, will be explained with reference to FIG. 16 as an example.

A barrier metal layer 61 prevents the copper from diffusing into the $SiO_2$ layer 60. The barrier metal layer 61 is made of tantalum nitride (TaN) or made by spattering tantalum (Ta). The copper layer 62 is made by electrolytic plating, etc.

The copper layer 62 is abraded, for example, in the pressurized air, with high abrasion rate until the barrier metal layer 61 is exposed.

A metal constituting the barrier metal layer 61 is harder than copper, if the abrasion is further continued, the copper layer 62 is abraded more, so that of the implanted wires will be too thin.

Figure 17:
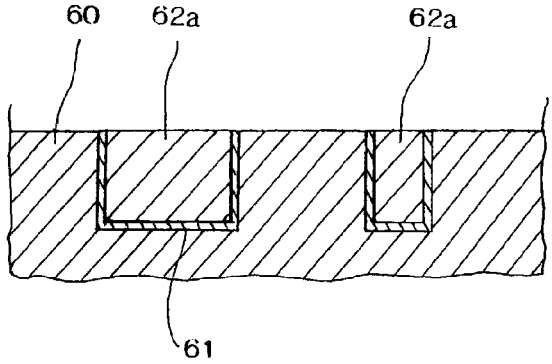
FIG. 17 is a sectional view of the implanted copper wires exposed.

Thus, for example, the copper layer 62 is abraded in the pressurized nitrogen (see FIG. 11) with low abrasion rate; the barrier metal layer 61 is abraded with high abrasion rate. With this manner, the barrier metal layer 61 and the copper layer 62 can be abraded at the same abrasion rate, so that proper implanted wires 62*a* can be formed as shown in FIG. 17.

The fluid in the bell jar 12 can be changed in one abrasion cycle so as to change the abrasion rate, so that the abrading conditions can be easily changed. The rotational speed of the abrasive plate 23, of course, may be controlled simultaneously.

The invention may be embodied in other specific forms without departing from the spirit or essential characteristics thereof. The present embodiments are therefore to be considered in all respects as illustrative and not restrictive, the scope of the invention being indicated by the appended claims rather than by he foregoing description and all changes which come within the meaning and range of equivalency of the claims are therefore intended to be embraced therein.

What is claimed is:

1. An abrasive machine, comprising:

a pressure vessel having a lid which opens or closes said pressure vessel, said pressure vessel being capable of increasing and reducing inner pressure;

an abrasive plate being provided in said pressure vessel;

a pressing plate being provided on said abrasive plate, said pressing plate pressing a work piece, which has been set between said abrasive plate and said pressing plate, onto said abrasive plate;

a driving unit relatively moving said abrasive plate with respect to said pressing plate so as to abrade the work piece;

a pressure source being connected to said pressure vessel, said pressure source increasing or reducing the inner pressure of said pressure vessel; and a plurality of rollers contacting an outer edge of said pressing plate so as to hold said pressing plate at a prescribed position on said abrasive plate.

2. The abrasive machine according to claim 1, wherein said rollers are rotatably held by an arm provided in said pressure vessel.

3. An abrasive machine, comprising:

a pressure vessel having a lid which opens or closes said pressure vessel, said pressure vessel being capable of increasing and reducing inner pressure;

an abrasive plate being provided in said pressure vessel;

a pressing plate being provided on said abrasive plate, said pressing plate pressing a work piece, which has been set between said abrasive plate and said pressing plate, onto said abrasive plate;

a driving unit relatively moving said abrasive plate with respect to said pressing plate so as to abrade the work piece;

a pressure source being connected to said pressure vessel, said pressure source increasing or reducing the inner pressure of said pressure vessel;

a slurry supplying unit supplying slurry onto said abrasive plate, wherein said slurry supplying unit has:

a slurry storing section being provided in said pressure vessel, said slurry storing section storing the slurry therein; and a circulation pump being provided outside of said pressure vessel, said circulation pump being connected to said slurry storing section and said pressure vessel so as to circulate the slurry between said slurry storing section and said abrasive plate.

4. The abrasive machine according to claim 3, wherein said driving unit moves said abrasive plate in a piano parallel to an abrasive face.

5. The abrasive machine according to claim 3, wherein said driving unit rotates said abrasive plate in a plane parallel to an abrasive face.

6. The abrasive machine according to claim 3, further comprising a slurry supplying unit supplying slurry onto said abrasive plate.

7. The abrasive machine according to claim 3, wherein said pressure source has:

a plurality of gas supplying units which respectively supply different gasses so as to increase the inner pressure; and a switching valve for switching the gas supplying unit to be connected to said pressure vessel.

8. The abrasive machine according to claim 3, further comprising an equipment for measuring the pressure in said pressure vessel.

9. The abrasive machine according to claim 3, wherein said driving unit is provided outside of said pressure vessel.

10. The abrasive machine according to claim 3, further comprising a press unit applying pressure to the work piece.

11. The abrasive machine according to claim 3, wherein a plurality of said pressing plates are provided and a pressure source is connected to said pressure vessel, said pressure source increasing or reducing the inner pressure of said pressure vessel.

12. An abrasive machine, comprising:

a pressure vessel having a lid which opens or closes said pressure vessel, said pressure vessel being capable of increasing and reducing inner pressure;

an abrasive plate being provided in said pressure vessel;

a pressing plate being provided on said abrasive plate, said pressing plate pressing a work piece, which has been set between said abrasive plate and said pressing plate, onto said abrasive plate;

a driving unit relatively moving said abrasive plate with respect to said pressing plate so as to abrade the work piece;

a pressure source being connected to said pressure vessel, said pressure source increasing or reducing the inner pressure of said pressure vessel;

a slurry supplying unit supplying slurry onto said abrasive plate, wherein said slurry supplying unit has:

a slurry storing section being provided in said pressure vessel, said slurry storing section storing the slurry therein; and a surface of said abrasive plate is inclined with respect to a horizontal plane so as to dip a lower part of the surface of said abrasive plate in the slurry.

13. A method of abrading a work piece, comprising the steps of:

setting the work piece between an abrasive plate and a pressing plate in a pressure vessel;

selectively changing an inner pressure in said pressure vessel by alternatively introducing a gas into said pressure vessel and withdrawing the gas from said pressure vessel by applying suction, said step of selectively changing the inner pressure including reducing the inner pressure to less than atmospheric pressure;

relatively moving said abrasive plate with respect to said pressing plate by said driving unit so as to abrade the work piece; and wherein said inner pressure of said pressure vessel is varied while abrading the work piece.

14. A method of abrading a work piece, comprising the steps of:

setting the work piece between an abrasive plate and a pressing plate in a pressure vessel;

selectively changing an inner pressure in said pressure vessel by alternatively introducing a gas into said pressure vessel and withdrawing the gas from said pressure vessel by applying suction, said step of selectively changing the inner pressure including reducing the inner pressure to less than atmospheric pressure;

relatively moving said abrasive plate with respect to said pressing plate by said driving unit so as to abrade the work piece; and wherein the gas in said pressure vessel is exchanged to another gas while abrading the work piece.

15. An abrasive machine, comprising:

a pressure vessel having a lid which opens or closes said pressure vessel, said pressure vessel being capable of increasing and reducing inner pressure;

an abrasive plate being provided in said pressure vessel;

a pressing plate being provided on said abrasive plate, said pressing plate pressing a work piece, which has been set between said abrasive plate and said pressing plate, onto said abrasive plate;

a driving unit relatively moving said abrasive plate with respect to said pressing plate so as to abrade the work piece;

a pressurizing unit being connected to said pressure vessel, said pressurizing unit for increasing the inner pressure of said pressure vessel by introducing a pressurized gas;

a pressure reduction unit being connected to said pressure vessel, said pressure reduction unit for reducing the inner pressure of said pressure vessel by applying suction thereto, said pressure reduction unit being capable of reducing the inner pressure of said pressure vessel to less than atmospheric pressure; and a plurality of rollers contacting an outer edge of said pressing plate so as to hold said pressing plate at a prescribed position on said abrasive plate.

16. An abrasive machine, comprising:

a pressure vessel having a lid which opens or closes said pressure vessel, said pressure vessel being capable of increasing and reducing inner pressure;

an abrasive plate being provided in said pressure vessel;

a pressing plate being provided on said abrasive plate, said pressing plate pressing a work piece, which has been set between said abrasive plate and said pressing plate, onto said abrasive plate;

a driving unit relatively moving said abrasive plate with respect to said pressing plate so as to abrade the work piece;

a pressurizing unit being connected to said pressure vessel, said pressurizing unit for increasing the inner pressure of said pressure vessel by introducing a pressurized gas;

a pressure reduction unit being connected to said pressure vessel, said pressure reduction unit for reducing the inner pressure of said pressure vessel by applying suction thereto, said pressure reduction unit being capable of reducing the inner pressure of said pressure vessel to less than atmospheric pressure;

a slurry supplying unit supplying slurry onto said abrasive plate, wherein said slurry supplying unit has:

a slurry storing section being provided in said pressure vessel, said slurry storing section storing the slurry therein; and a circulation pump being provided outside of said pressure vessel, said circulation pump being connected to said slurry storing section and said pressure vessel so as to circulate the slurry between said slurry storing section and said abrasive plate.

17. The abrasive machine according to claim 16, wherein said driving unit moves said abrasive plate in a plane parallel to an abrasive face.

18. The abrasive machine according to claim 16, wherein said driving unit rotates said abrasive plate in a plane parallel to an abrasive face.

19. The abrasive machine according to claim 16, further comprising a slurry supplying unit supplying slurry onto said abrasive plate.

20. The abrasive machine according to claim 16, wherein said pressure source has:

a plurality of gas supplying units which respectively supply different gasses so as to increase the inner pressure; and a switching valve for switching the gas supplying unit to be connected to said pressure vessel.

21. The abrasive machine according to claim 16, further comprising an equipment for measuring the pressure in said pressure vessel.

22. The abrasive machine according to claim 16, wherein said driving unit is provided outside of said pressure vessel.

23. The abrasive machine according to claim 16, further comprising a press unit applying pressure to the work piece.

24. The abrasive machine according to claim 16, wherein a plurality of said pressing plates are provided.

* * * * *